US009499951B2

(12) United States Patent
Levey et al.

(10) Patent No.: US 9,499,951 B2
(45) Date of Patent: Nov. 22, 2016

(54) SELF-DRILLING ROCK BOLT ASSEMBLY AND METHOD OF INSTALLATION

(71) Applicant: OKA Rock Bolt Technologies Pty Limited, Newcastle, New South Wales (AU)

(72) Inventors: Mark Levey, Newcastle (AU); Paul Charlton, Newcastle (AU)

(73) Assignee: OKA ROCK BOLT TECHNOLOGIES PTY LIMITED, Newcastle (AU)

( * ) Notice: Subject to any disclaimer, the term of this patent is extended or adjusted under 35 U.S.C. 154(b) by 0 days.

(21) Appl. No.: 14/894,107

(22) PCT Filed: May 27, 2014

(86) PCT No.: PCT/AU2014/000558
§ 371 (c)(1),
(2) Date: Nov. 25, 2015

(87) PCT Pub. No.: WO2014/190382
PCT Pub. Date: Dec. 4, 2014

(65) Prior Publication Data

US 2016/0130778 A1 May 12, 2016

(30) Foreign Application Priority Data

May 27, 2013 (AU) ..... 2013901882

(51) Int. Cl.

| | |
|---|---|
| ***E02D 7/24*** | (2006.01) |
| ***E21D 20/02*** | (2006.01) |
| ***E02D 5/80*** | (2006.01) |
| ***E02D 7/22*** | (2006.01) |
| ***E21D 20/00*** | (2006.01) |

(52) U.S. Cl.
CPC ..... *E02D 7/24* (2013.01); *E02D 5/801* (2013.01); *E02D 7/22* (2013.01); *E21D 20/003* (2013.01); *E21D 20/02* (2013.01); *E21D 20/028* (2013.01); *E21D 21/0053* (2016.01)

(58) Field of Classification Search
USPC ..... 405/259.1
See application file for complete search history.

(56) References Cited

U.S. PATENT DOCUMENTS 4,732,509 A * 3/1988 Leppanen ..... E21D 20/028 405/259.5
6,004,077 A * 12/1999 Saab ..... E21D 21/0086 405/288

(Continued)

FOREIGN PATENT DOCUMENTS

AU 2005201548 B2 3/2007

OTHER PUBLICATIONS

International Search Report for Corresponding Application No. PCT/AU2014/000558; Dated Aug. 6, 2014.

*Primary Examiner* — Benjamin Fiorello
*Assistant Examiner* — Kyle Armstrong
(74) *Attorney, Agent, or Firm* — Pearne & Gordon LLP

(57) ABSTRACT

A self-drilling rock bolt assembly (1) including a drill head mechanism (100) and a fluid delivery system (300) operatively associated with each other and adapted in use to secure a self-drilling rock bolt (200) into a strata (2). The rock bolt (200) having a shaft (210) having a cutting end (220) and a driving end (230). The drill head mechanism (100) having a bolt coupling portion (130) to releasably engage with the driving end (230) of the rock bolt (200). Wherein rotation of the bolt coupling portion (130) rotates the rock bolt. A central hollow portion (111) provides access to a fluid connection port (232) of the rock bolt and a nut coupling portion (120) releasably engages with a nut element (250) located on the shaft of the rock bolt. Wherein rotation of the nut coupling portion rotates the nut element. The fluid delivery system (300) has an injection nozzle (320) in communication with one or more sources of fluid for delivering measured quantities of one or more fluids to a predetermined location about said assembly. Each source of fluid including a reservoir (310, 311, 312) in fluid communication with a pump (313, 314, 315). The pump being in fluid communication with the injection nozzle so that said fluid from said reservoir is adapted to be pumped to said predetermined location. Whereby in use said drill head mechanism drives the rock bolt into the strata by rotating in a drilling direction the rock bolt and nut element at the same rate such that the nut element remains in the same position relative to the shaft of the rock bolt.

20 Claims, 9 Drawing Sheets

(56) References Cited

U.S. PATENT DOCUMENTS 7,591,328 B2 * 9/2009 Guede ..... E21D 20/028 175/118

2006/0153645 A1 * 7/2006 Rataj ..... E21D 20/026 405/259.5

2011/0070035 A1 3/2011 Ricardo

* cited by examiner

SELF-DRILLING ROCK BOLT ASSEMBLY AND METHOD OF INSTALLATION

FIELD

The present invention relates to a self-drilling rock bolt assembly and method of installation. In particular, a semi or fully automated self-drilling rock bolt assembly to operate on a continuous miner, tunnel boring machine, mobile bolting machine, building/construction bolting into concrete tools or the like.

BACKGROUND

Rock bolts are common throughout the world and are typically drilled into strata and retained therein to provide support to the integrity of the strata which assists with supporting structures. For example, rock bolts can be used in the construction and maintenance of mines, tunnels, passageways, canals, enclosures, shafts, halls, access ways, subways or the like.

In underground tunneling, for example, rock bolts are often installed at progressive intervals along the tunnel. During the construction of the tunnel it is desirable to provide a rock bolt that is easy to secure into the strata with the least human intervention due to the highly hazardous environment.

The most common method of securing a rock bolt to strata is to drill a hole in the strata using a drill rig with a drill rod. Once the hole has been bored and the drill rod is retracted from the hole, the drill rod is removed from the drill chuck. A bolt is then inserted into a drive dolly which is an adapter between the bolt and drive chuck. A resin capsule is then inserted into the bored hole. The bolt is then inserted into the bore hole causing the resin capsule to rupture. The bolt is then rotated to promote mixing and dispersion of the resin. Once the resin has set, a nut on the end of the bolt is rotated and the nut comes into contact with the collar of the hole. Torque is applied to the nut on contact with the collar of the borehole and the nut places tension over the length of the bolt that has not been already anchored to the strata. As a result, the strata is then placed in compression, containing the strata.

The above described bolting method has many steps and involves a high level of manual handling. Repetitive manual handling tasks of this type ultimately lead to accidents and injuries. The speed of installation of a bolt is governed by the proficiency of the operator, and this can vary considerably. Production demands require an efficient installation time for strata support, however, this method takes time due to the many steps involved.

Self-drilling rock bolts were developed to overcome the above disadvantages. They are known for providing a single drilling and securing function. This negates the need to drill a hole, withdraw the drill rod and subsequently insert a bolt into the hole using various methods of anchoring.

Hollow, steel, self drilling rock bolt versions have been developed to minimize the number of cycles involved when rock bolting strata. One self drilling rock bolt utilizes the centre hole of the bolt as the delivery port for water during the drilling process as well as an avenue to pump cement grouts and resins of various sorts to anchor and encapsulate the bolt. The self drilling rock bolt is then simply filled both internally and externally about the bolt annulus, and therefore provide a dowel support to the strata. No tension is applied to the length of the bolt in the strata.

Mechanically anchored self drilling rock bolts are also available. They can be used in combination with cement grouts or resins that are inserted post anchoring with the mechanical anchor. However, the mechanical anchor technique can also fail when the surrounding borehole strata is weak and is unable to provide sufficient resistance to allow tensioning. The bolt is heavier than alternate options and the system is also slow due to the post grouting step for full encapsulation.

Another self-drilling rock bolt system utilizes a hollow bar with a chemical resin capsule already placed in the centre of the bar. Water is used as the drill and flush medium and travels through the middle of the bolt. Once the hole is drilled using the bolt, water is delivered into the cavity of the bolt containing the resin capsule. The water forces the resin capsule to disperse and mix before flowing around the annulus of the bolt. When the chemical resin has set, the bolt has reinforced the strata in the form of a dowel. The disadvantage of this system is that the bolt is very expensive to manufacture due to the internal arrangements within the bolt. Also, each bolt then has a shelf life based on the resin cartridge expiration.

In addition to the above disadvantages, existing self-drilling rock bolts, though used throughout the world, are expensive, time consuming to install, heavy, cumbersome and complicated to install correctly. Also full automation has not yet been achieved for installing traditional self-drilling rock bolts. Mechanical anchors, static mixers, individual chemicals, springs and the like also make known self-drilling rock bolt systems non automatable. Mechanical anchors in soft strata conditions can also fail and therefore won't allow the bolt to be pre-tensioned.

It is beneficial to apply pre-tension to an installed rock bolt to provide greater resistance to any strata movement. This can be accomplished by applying tension to the rock bolt once it has been secured to the strata by the hardening substance for a predetermined distance along the bolt effectively straining the bolt longitudinally, and then securing the rock bolt in tension using the nut and thread against the drill hole collar.

Accordingly, there is a need to provide a rock bolt drill head mechanism, a self-drilling rock bolt, a fluid delivery system and a method for securing the self-drilling rock bolt to strata that separately (or together) provides that the strata is supported quickly, reliably and efficiently, increases worker safety, provides significant automation, can be pre-tensioned, provides a multi-use injection system for use with multiple substances, reduces costs, provides productivity improvements and reduces the amount of human intervention and hence improves safety at an operation site.

OBJECT OF INVENTION

It is an object of the present invention to substantially overcome or at least ameliorate one or more of the disadvantages of the prior art, or to at least provide a useful alternative.

SUMMARY OF INVENTION

In one broad form, the present invention discloses a self-drilling rock bolt assembly including a drill head mechanism and a fluid delivery system operatively associated with each other and adapted in use to secure with pre-tension, chemically, via injection, a self-drilling rock bolt into a strata; the rock bolt including a shaft having a cutting end and a driving end; the assembly including:

a. the drill head mechanism having:
- a bolt coupling portion to releasably engage with the driving end of the rock bolt, wherein rotation of the bolt coupling portion rotates the rock bolt;
- a central hollow portion providing access to a fluid connection port of the rock bolt; and,
- a nut coupling portion to releasably engage with a nut element located on the shaft of the rock bolt, wherein rotation of the nut coupling portion rotates the nut element;

b. the fluid delivery system having:
- an injection nozzle in communication with one or more sources of fluid for delivering measured quantities of one or more fluids to a predetermined location about said assembly,
- each source of fluid including a reservoir in fluid communication with a priming pump, the priming pump being in fluid communication with the displacement pump, the displacement pump being in fluid communication with the injection nozzle, so that said fluid from said reservoir is adapted to be pumped to said predetermined location;
- a cleaning flush phase for each separate internal passage within the injection nozzle, that has each cleaning fluid sourced from a different reservoir pressure source;

whereby in use said drill head mechanism drives the rock bolt into the strata by rotating in a drilling direction the rock bolt and nut element at the same rate such that the nut element remains in the same position relative to the shaft of the rock bolt.

Preferably, the nut coupling portion drives an outside surface of the nut element.

Preferably, the bolt coupling portion includes one or more male connectors that engage with one or more corresponding female connectors of the rock bolt, the male connectors driving an inside surface of the rock bolt.

Preferably, the bolt coupling portion includes a main body with a central hollow corresponding to the central hollow of the drill head mechanism, wherein the one or more male connectors include a protrusion from a top surface of the main body extending in a direction parallel to a longitudinal axis of the central hollow and adapted to operatively couple with the female connector in the driving end of the rock bolt.

Preferably, in a first position the nut coupling portion is engaged with the nut element and the bolt coupling portion is engaged with the driving end of the rock bolt, and in a second position the nut coupling portion is engaged with the nut element and the bolt coupling portion is disengaged with the driving end of the rock bolt.

Preferably, the drill head mechanism advances the nut element along the rock bolt by rotating in the drilling direction while in the second position thereby tensioning the rock bolt.

In a further form there is disclosed herein a self-drilling rock bolt, the rock bolt including:
- the shaft having a hollow portion defining a central conduit;
- the fluid connection port containing a fluid seal;
- the cutting end at one end of the shaft where a cutting tip is fixed; and,
- the driving end at the other end of the shaft adapted to operatively female couple to the drill head mechanism, wherein rotation of the drill head mechanism rotates the shaft;
- the shaft including an external thread at or towards the driving end that engages with the nut element such that rotation of the nut element relative to the shaft causes the nut element to move in an axial direction along the shaft.

Preferably, the central conduit provides fluid communication between a fluid connection port at the driving end and a fluid exit at the cutting end. A seal in the fluid connection port at the driving end of the central conduit ensures that there is no fluid leakage at the fluid connection and that all fluids exit the central conduit at the cutting end.

Preferably, the coupling end includes one or more slots arranged radially about the fluid connection port, each slot adapted to receive therein a male connector of the bolt coupling portion of the drill head mechanism.

Preferably, the cutting tip is fixed to the rock bolt so that it creates a fluid exit for fluids to exit the central conduit.

Preferably, the assembly further includes a mesh screen surrounding the rock bolt to permit fluid to exit a void surrounding the rock bolt by flowing through the mesh screen but resists higher viscosity hardening substances flowing therethrough to exit the void.

Preferably, the fluids include one or more of: a slow set hardening substance; a fast set hardening substances; a catalyst to initiate the hardening of the slow and/or fast set hardening substance; water; steam; gas; air; cleaning fluid; and/or flushing fluid.

Preferably, the assembly further includes a control system to control the ratios and volumes of each fluid supplied to the rock bolt and movement of the drill head mechanism with respect to the strata.

Preferably, the injection nozzle includes:
- a plurality of separate internal passages through which various fluids may flow;
- a needle portion of elongate shape, with one end adapted to couple with the rock bolt and including openings for fluids to exit the internal passages; and,
- a base portion including fluid inlets in fluid communication with the internal passages.

Preferably, the base portion of the injection nozzle includes a plurality of separate inlets, wherein more than one of the inlets may be in fluid communication with the same internal fluid passage.

Preferably, the injection nozzle in use extends through the central hollow of the drill head mechanism into the fluid connection port while the drill head mechanism is coupled with the rock bolt, and whereby in use the injection nozzle does not rotate as the drill head mechanism and/or rock bolt rotates.

In a further form there is disclosed herein a method of installation of the self-drilling rock bolt assembly, the method including the steps of:
- rotating the rock bolt and the nut element together in the drilling direction using the drill head mechanism such that the rock bolt advances into the strata;
- delivering the hardening substances by the fluid delivery system;
- spinning the rock bolt; and,
- tensioning the rock bolt by rotating the nut element in the drilling direction relative to the rock bolt so that the rock bolt is anchored in the strata.

Preferably, the method further includes the steps of:
a. a slow setting hardening substance is first sent through the rock bolt, then
b. a fast setting hardening substance is sent through the rock bolt; then either or both;
c. a slow setting hardening substance is sent into the central conduit of the rock bolt; and/or d. a cleaning fluid is sent into the central conduit of the rock bolt; so that the rock bolt is tensioned after the fast setting hardening substance has hardened and before the slow setting hardening substance has hardened.

Preferably, the drill head mechanism rotates the rock bolt and nut element at the same rate in a drilling direction, causing the rock bolt to be drilled into the strata, then decouples from the rock bolt; but is still coupled to the nut via the nut coupling portion, and further rotates in the drilling direction or opposite the drilling direction to cause the nut element to advance along the rock bolt, thereby causing the rock bolt to be placed in tension.

Preferably, the fluid delivery system supplies a plurality of different fluids throughout the assembly as determined by the control system.

DESCRIPTION OF THE DRAWINGS

The present invention will become more fully understood from the following detailed description of preferred but non limiting embodiments thereof, described in connection with the accompanying drawings, wherein.

DETAILED DESCRIPTION

Throughout the drawings, like numerals will be used to identify similar features, except where expressly otherwise indicated.

Figure 1:
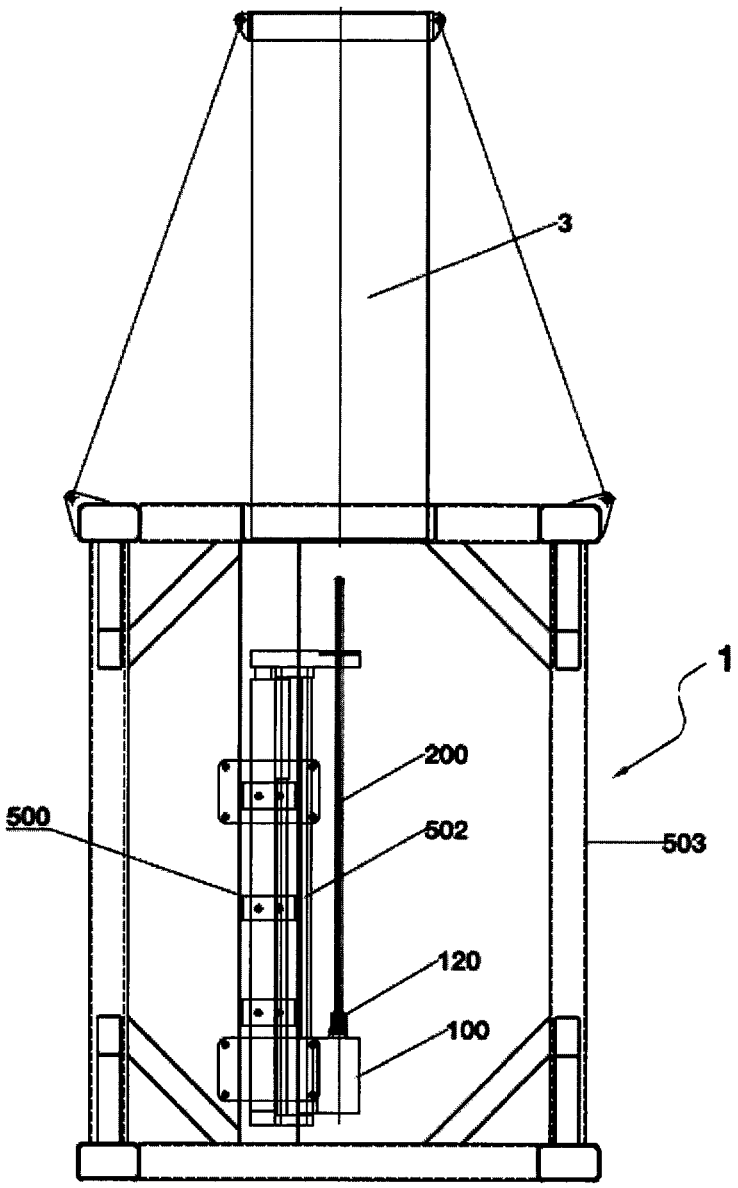
FIG. 1 is the test apparatus to install a self-drilling rock bolt assembly 200 in test substance 3 shown in the start position.
Figure 2:
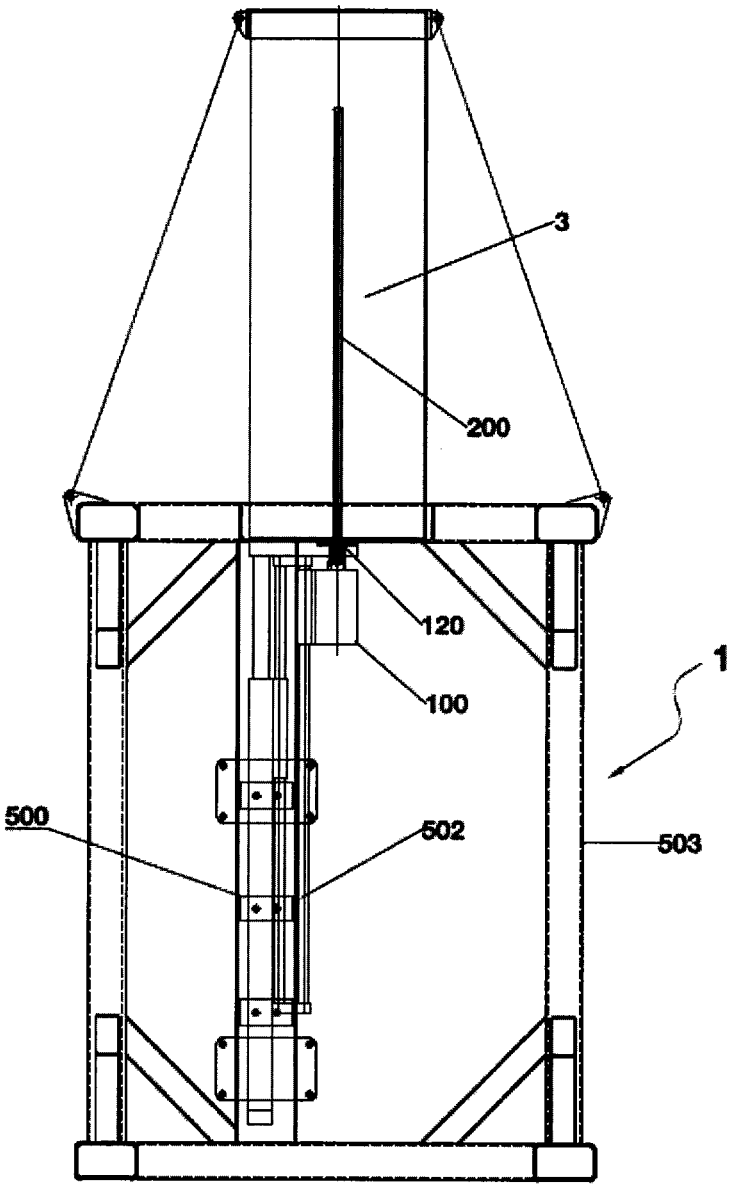
FIG. 2 is the test apparatus to install a self-drilling rock bolt assembly 200 in test substance 3 shown in the installed position.
Figure 8:
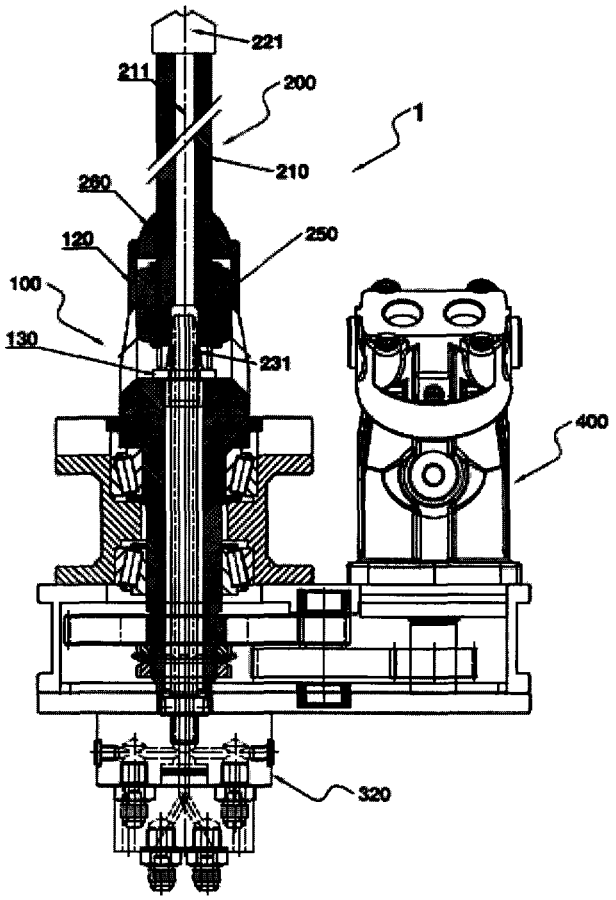
FIG. 8 is a cross sectional view of a drive head mechanism, injection nozzle and self-drilling rock bolt operationally coupled to a drill motor; and, FIG. 9 includes plan view, side elevation and bottom view of the bolt coupling portion of the drill head mechanism as well as two cross section views of the drill head mechanism in a first position where the bolt coupling portion is engaged with the female connector of the self-drilling rock bolt, and a second position where the bolt coupling portion is not engaged with the female connector, the nut coupling portion being engaged with the nut element in both positions.

In FIGS. 1 and 2 is shown a test apparatus for installing self-drilling rock bolts 200 in a test substance 3. The test apparatus frame 503 carries the test substance 3 and the loads incurred while installing a self-drilling rock bolt 200 with drilling assembly 500. The articulation system of the test apparatus allows multiple self-drilling rock bolts 200 to be installed in test substance 3. In a preferred, but non limiting embodiment, as best seen in FIGS. 1, 2 and 8 the present invention relates to a self-drilling rock bolt assembly 1 that includes a drill head mechanism 100 and a fluid delivery system 300 operatively associated with each other and adapted in use to secure a self-drilling rock bolt 200 into a strata 2. In particular, the drill head mechanism 100 installs self-drilling rock bolts 200 either under tension or not under tension. In a preferred form, they would be installed under tension.

Figure 4:
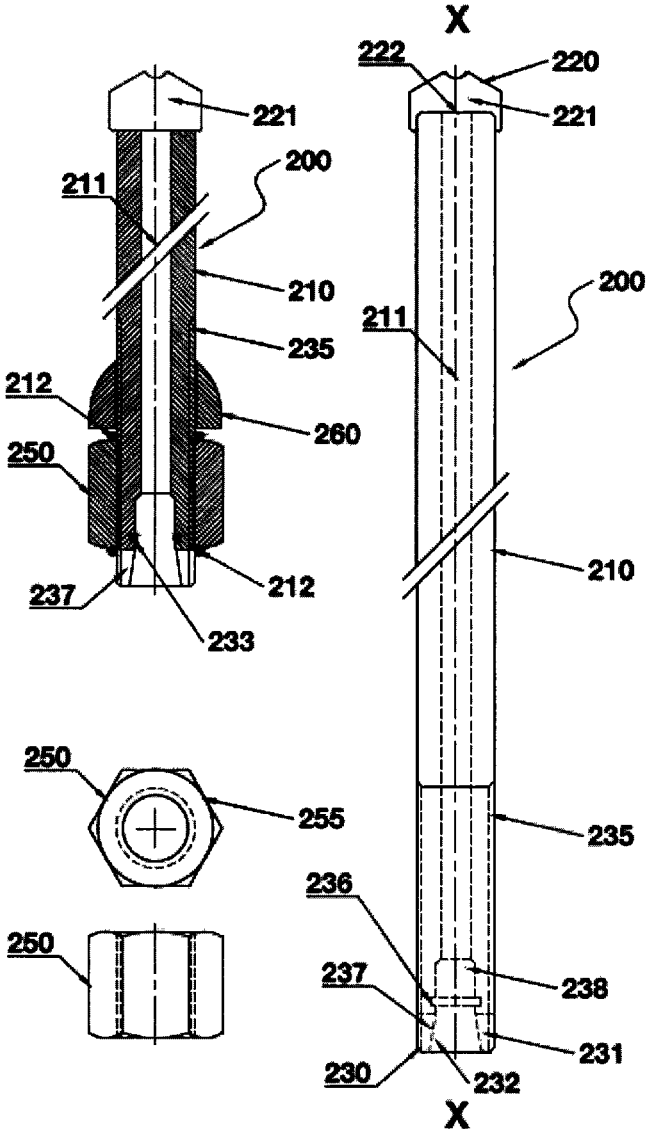
FIG. 4 includes a cross sectional view of a self-drilling rock bolt without the nut element as well as a further cross section view of a self-drilling rock bolt including a nut element and dome washer. In addition, there is shown a front elevation and a plan view of a nut element.

Rock bolts 200 are typically used for supporting roof, wall and/or floor structures in the construction and maintenance of mines, tunnels, passageways, canals, enclosures, shafts, halls, access ways, subways or the like. A plurality of self-drilling rock bolts 200, as illustrated in FIG. 4, are used in cooperation with the assembly 1. The speed at which the rock bolts 200 are installed by using the assembly 1 will be determined mostly by the level of automation used and the speed at which the drilled strata can be removed from the drilling site. The rock bolt 200 includes a longitudinally extending main shaft 210 that has a central conduit 211 defining a longitudinal axis X, a cutting end 220 where a cutting tip 221 is fixed and a driving end 230. The main shaft 210 also has an external thread 235 located towards the driving end 230 with which a nut element 250 engages, such that the nut element 250 moves along the outside of the main shaft 210 when rotated relative to the main shaft 210. The rock bolt 200 will typically be made from steel with either a ribbed or plain outer surface, however can be made from any other suitable material. Other materials that could be used include, but are not limited to, carbon fibre, fiberglass, Kevlar™ composite, other composite materials, plastic or metals and alloys other than steel, galvanized, anti-rust materials or the like.

Figure 9:
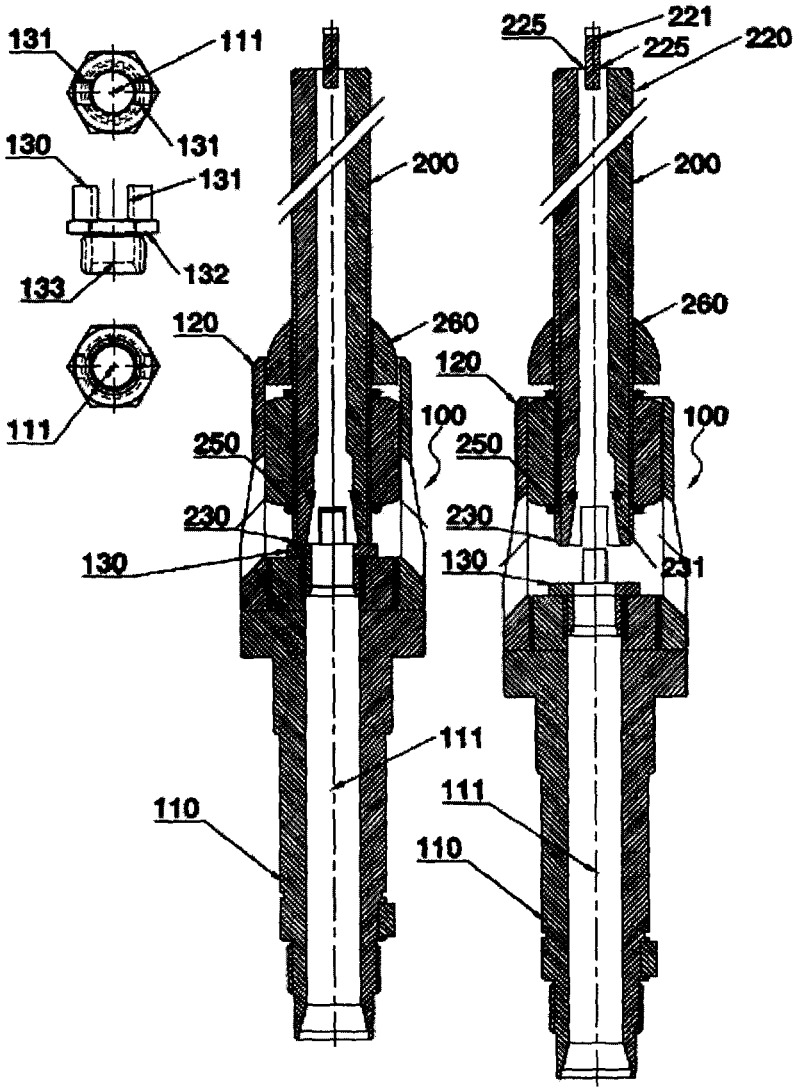

The cutting tip 221 of the rock bolt 200 includes a piece (or a number of pieces) of tungsten carbide, hardened steel or some other suitable material depending upon the drilling material. In the preferred embodiment, the piece fits into a slot (not shown) in the cutting end 220 of the rock bolt 200. The piece is braised, welded, threaded, screwed, adhesively bonded, snap lockingly engaged or the like in place. In the preferred form, the central conduit 211 extends right to the ends 220, 230 of the rock bolt 200, however as the cutting tip 221 extends across the rock bolt 200 it divides the exit into two smaller openings 225, one on either side of the cutting tip 221 as best seen in FIG. 9. Many alternative cutting tip designs are possible and these may result in a single fluid exit or many fluid exits. For example, the cutting tip 221 is fixed to the rock bolt 200 to create or provide one or more fluid exits 225. The exits 225 can be located in any location such as the centre, sides or the like.

Figure 3:
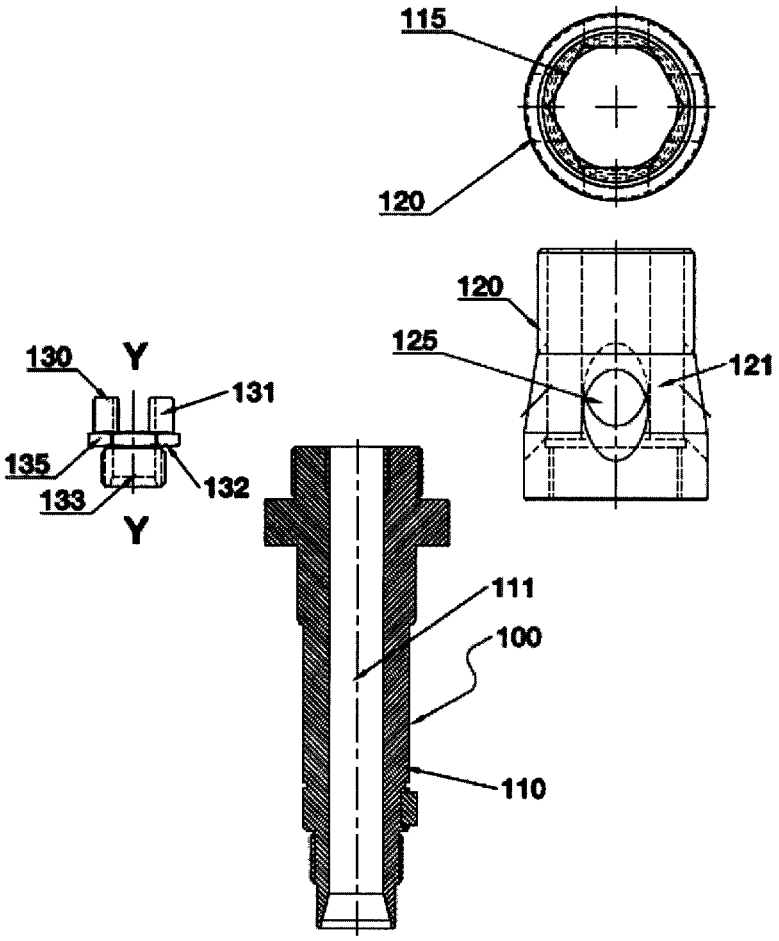
FIG. 3 includes an exploded side view of a drill head mechanism as well as a plan view of a nut and bolt coupling portions.
Figure 5:
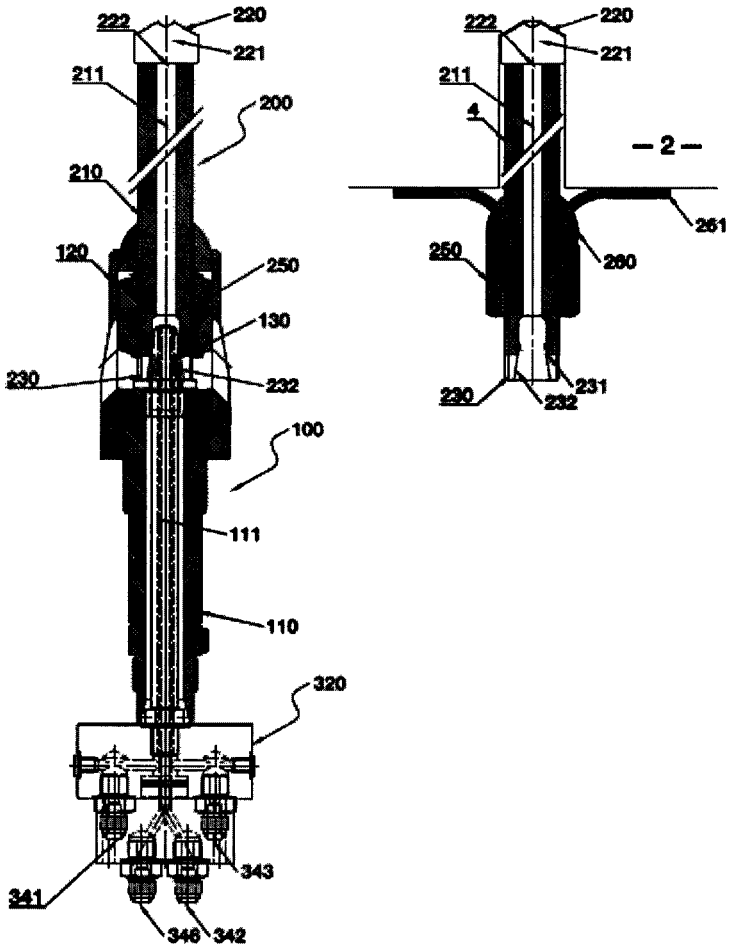
FIG. 5 is a cross sectional view of an assembly including injection nozzle, drill head mechanism and self-drilling rock bolt and also a cross sectional view of a self-drilling rock bolt anchored in a rock substrate together with a plate washer.

Referring to FIG. 3, the drill head mechanism 100 is shown split into three main component parts. The main component parts comprise a main body 110, a nut coupling portion 120 and a bolt coupling portion 130. The main parts could be integrally formed into a single unit or be separate parts operatively associated with each other in use. FIGS. 5, 8 and 9 show the drill head mechanism 100 with the three main component parts in the assembled state for installing self-drilling rock bolts 200.

As best seen in FIGS. 3 to 5, the drill head mechanism 100 is able to couple with both the nut element 250 and the driving end 230 of the rock bolt main shaft 210. The nut coupling portion 120 fits over the nut element 250 and is adapted to drive the outside surface 255 of the nut element 250 when the nut coupling portion 120 is rotated. The nut coupling portion 120 has an interior surface 115 which corresponds to the external profile 255 of the nut element 250. In the present embodiment, the external profile 255 of the nut element 250 is a hexagonal cross section as best depicted in FIG. 4 which corresponds to a hexagonal profiled interior surface 115 (see FIG. 3). However it will be appreciated that any suitable corresponding cross section that is capable of being driven may be used. For example, a triangle, octagon, square, rectangle or the like.

The nut coupling portion 120 includes one or more orifices 125 (as best seen in FIG. 3) which pass through the side 121 of the nut coupling portion 120 and provide fluid communication from the bolt coupling portion 130 of the drill head mechanism 100 to allow excess material from the drilling, anchoring and tensioning of the self-drilling rock bolt 200 to exit with gravity assistance from the bolt coupling portion 130. The material could be fluids, drill cuttings, debris, excess material, gases, dirt or the like.

The bolt coupling portion 130 is located in a central axial position of the drill head mechanism 100 and includes male connectors 131 (as best seen in FIG. 3) that engage with corresponding female connectors 231 located at the self-drilling rock bolt 200 driving end 230. In another embodiment, the male and female connectors 131, 231 could be reversed. That is, the driving end 230 of the bolt 200 could have one or more male and/or female connectors 131, 231. The number of male and female connectors 131, 231 can vary depending upon operation and need.

In the current embodiment, the bolt coupling portion 130 includes male connectors in the form of two tabs 131, however any suitable number of tabs 131 may be used. As with the main body 110 of the drill head mechanism 100, the bolt coupling portion 130 has a corresponding central hollow 133 to allow access to the fluid injection port 232 of the self-drilling rock bolt 200 when operatively engaged with the drill head mechanism 100. The tabs 131 are arranged around the central hollow 133 and protrude out from the top surface 135 of the main body 132 of the bolt coupling portion 130 in a direction parallel to the longitudinal axis Y of the central hollow 133. This allows the tabs 131 to fit into female connectors in the form of a slot or slots 231, arranged around the fluid injection port 232 at the driving end 230 of the rock bolt 200.

As shown in at least FIGS. 5, 8 and 9, when the drill head mechanism 100 rotates, the bolt coupling portion 130 rotates and the male connectors 131 to drive the inside surface 237 of the female connectors 231. In the preferred embodiment, the bolt coupling portion 130 sits inside the nut coupling portion 120 such that it can couple to the rock bolt 200 from the end 230, with the nut coupling portion 120 coupling to the outside 255 of the nut element 250 also located towards the driving end 230 of the rock bolt 200.

The drill head mechanism 100 also includes a central hollow portion 111 that provides access to the fluid connection port 232 of the rock bolt 200. In the current embodiment this is achieved with the injection nozzle 320 of the fluid supply system 300. As best depicted in FIG. 6, the injection nozzle 320 includes a needle portion 330 of elongate shape such that it can extend into the central hollow portion 111 through the length of the drill head mechanism 100.

FIG. 5 shows the drill head mechanism 100 connected to the rock bolt 200 with the injection nozzle 320 inserted into the drill head mechanism 100 and coupled with the fluid connection port 232. The fluid connection port 232 is in fluid communication with the central conduit 211, allowing fluids to be delivered to the fluid exit 222 at the cutting end 220 of the rock bolt 200. It should be appreciated that the configuration of the fluid exit 222 could be formed in a number of ways and include a variety of shapes, sizes and/or orientations to suit the fluid which could be a hardening substance, water, steam, gas, air, cleaning fluid, flushing fluid or the like. The exit 222 could also be utilised to permit material to exit the assembly 1 as mentioned above.

Figure 6:
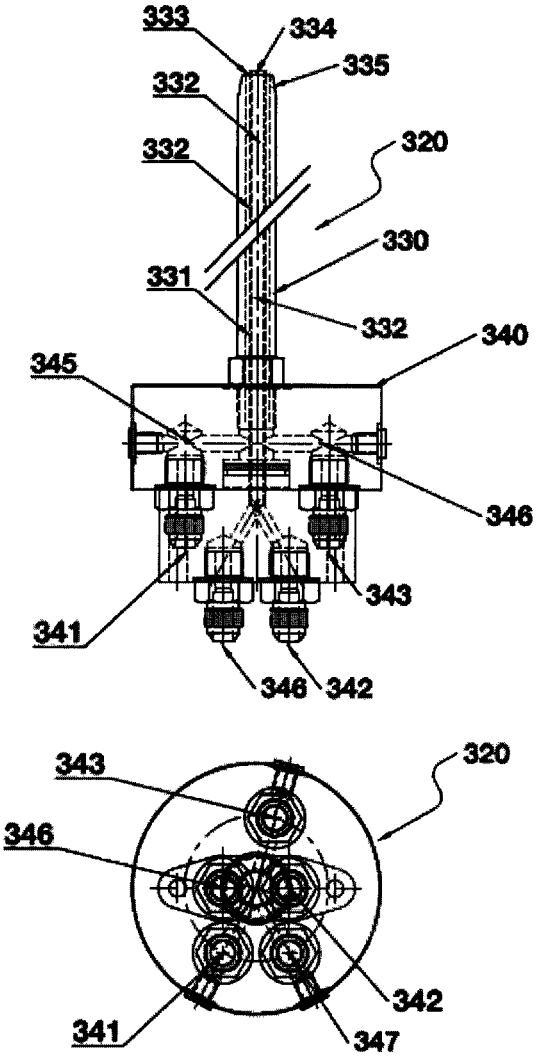
FIG. 6 includes a cross sectional view and a plan view of an injection nozzle.

As shown in FIG. 6, the end 335 of the injection nozzle 320 is tapered to aid coupling with the fluid connection port 232 and to match the internal shape 237 of the fluid connection port 232 of the self-drilling rock bolt 200. The inside 237 of the fluid connection port 232 also contains a seal 233 that may be partially embedded in a slot 236 on the inside surface 237 or retained in some other manner. The seal 233 may be a standard O-ring, a crankshaft seal that allows easy insertion while aiding sealing as the internal pressure increases, or any other seal or sealing type device that may be suitable for such a purpose. It should be appreciated that seal 233 may be located within the slot 236 (as shown in FIG. 4) or the internal surface 237 may be flush and the seal pushed up towards the top portion 238 of the port 232.

In the preferred embodiment, the injection nozzle 320 does not rotate with rotation of the drill head mechanism 100 when inserted and coupled to the fluid connection port 232 of the self-drilling rock bolt 200. That is, the needle 330 stays substantially still during operation as the rock bolt 200 rotates about it. This is advantageous as the needle 330 has a small diameter providing a low surface speed. Also, as the needle 330 is used many times during the life of the assembly 1, if it rotated it (and its seals) would be worn out creating significant additional maintenance, down time and expenditure. The rock bolt 200 is only being used once and left in place in the strata 2.

Referring to FIG. 6, the injection nozzle 320 has at least two concentric passages including a central channel 332 and an outer channel 331 in the needle portion 330. This allows at least two fluids to be supplied at the same time without the fluids mixing until they exit (333, 334) the injection nozzle 320. This is advantageous because hardening substances are typically made up of two components, with hardening only occurring after the components are mixed. The injection nozzle 320, however, may have any number of internal passages 331, 332 which may or may not be concentric.

For example, in a preferred embodiment, the slow setting hardening substance is made up of a slow set resin and a catalyst, while the fast setting hardening substance is made up of a fast set resin and a catalyst, wherein the same catalyst is used for the slow and fast setting hardening substances. This means a single catalyst may be delivered via the central channel 332 in the injection nozzle 320 and the slow and fast set resins may be supplied sequentially via the outer channel 331. Alternatively, the resins may be delivered via the central channel 332 and the catalyst via the outer channel 331. Any combination of fluid sources may supply any number of channels. There could be several different catalysts being delivered by separate channels and several different water or steam or air channels or the like being delivered by separate channels.

Referring to FIG. 6, an example is shown where the fluid injection nozzle 320 also includes a base portion 340 with a catalyst inlet 342 and two resin inlets 341, 343. The fast set resin inlet 341 is connected by an internal channel 345 to the outer channel 331, while the slow set resin inlet 343 is also connected to the outer channel 331 via an internal channel 346. Two further inlets 348 and 347 deliver water to either the central channel 332 or the outer channel 331.

Figure 7:
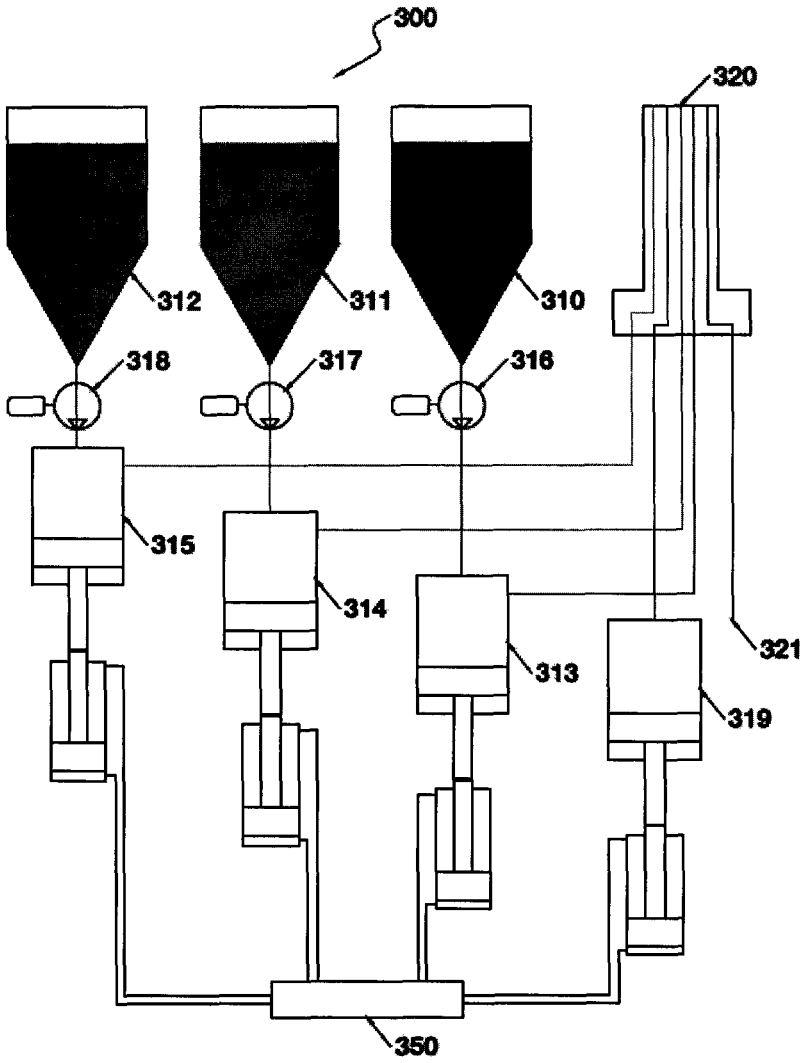
FIG. 7 is a schematic layout of a fluid delivery system in connection with a schematic representation of an injection nozzle.

Referring to FIG. 7, the fluid delivery system 300 delivers the various fluids to the injection nozzle 320. The embodiment shown includes hardening substances in the form of a fast and slow set resin which hardens in the presence of a catalyst. A slow set resin reservoir 311, a catalyst reservoir 312 and a fast set resin reservoir 310 are shown in the drawings. A priming pump 317 draws from the slow set resin reservoir 311 which is in fluid communication with displacement pump 314. Similarly a priming pump 318 draws from the catalyst resin reservoir 312 which is in fluid communication with displacement pump 315. Similarly a priming pump 316 draws from the slow set resin reservoir 310 which is in fluid communication with displacement pump 313. Water, gas, air, steam or the like is delivered via two different sources, 319, 321 which are each delivered to the injection nozzle 320. The two different sources are each directed to either the outer channel 331 or the central channel 332. There could however be more than two sources.

Various valves and transducers are shown in the fluid delivery system 300 in FIG. 7, which coordinate with the control system 350 to supply precise volumes of the various fluids at given times to the injection nozzle 320. Exact volumes are required to ensure the correct portions of the rock bolt 200 are anchored with each resin. Also, ensuring exact ratios of resin to catalyst are essential to provide adequate hardening and predictable time taken for the substances to harden.

The fluid delivery system 300 may optionally include an additional supply of a different catalyst and/or one or more pressure supply sources 319, 321 or an alternative fluid, gas, air, steam, vacuum or the like for use during the drilling process and/or after delivery of the resins and catalyst for cleaning, maintenance or the like. For example, an inert chemical could be used to flush the system. The fluid delivery system 300 may also remove or add any combination of reservoirs and associated components depending on the particular combination of fluids required in the drilling and anchoring process. Positive or negative pressure could also be provided to the system.

In the preferred embodiment, water is supplied to the central channel 332 and the outer channel from separate sources of water after the hardening and catalyst substances are delivered for cleaning purposes. However, any suitable fluid may be used in any or all of the channels for this purpose. Depending upon the reservoir size, the drilling and bolting process could continue indefinitely providing a continuous installation process.

In accordance with certain embodiments, there is also provided a method of drilling, anchoring and tensioning a self-drilling rock bolt 200 in to a strata 2. The method commences with a drilling operation wherein the drill head mechanism 100 as herein described is coupled to both the rock bolt 200 and the nut element 250. When in this first position, rotating the drill head mechanism 100 in the drilling direction, typically clockwise however could be anti-clockwise, rotates both the rock bolt main shaft 210 and the nut element 250 at the same rate in the drilling direction. As they are rotated at the same rate, the nut element 250 does not advance along the thread 235 of the rock bolt main shaft 210.

As depicted in FIGS. 1, 2 and 8, the drill head mechanism 100 is typically coupled to a drive motor 400 which causes rotation of the drill head mechanism 100. The drive motor 400 and drill head mechanism 100 may be operatively coupled to a mast 502 of a drilling assembly 500 wherein a mechanism is able to move the drive motor 400 and drill head mechanism 100 along the length of the mast 502. When the drive motor 400 is operated which enables rotation of the drill head mechanism 100 in the drilling direction, the drill head mechanism 100 and drill motor 400 may be advanced up the mast thereby drilling the self-drilling rock bolt 200 into a rock substrate 2.

During the drilling step, fluid (as described herein, such as water, gas, air, steam or the like) is supplied to the cutting tip 221 via the central conduit 211 for cooling and for removal of particulate material formed by the drilling process. The fluid may be supplied to the central conduit 211 via the injection nozzle 320 or by some other supply system. In the preferred embodiment, the fluid is delivered via the central channel 332 of the injection nozzle 320. While water is a common fluid used for this purpose, any other suitable fluid may be used, such as air, steam, solvent, gases, vacuums or the like. That is, the drilling operation could be a wet or dry drilling process and include positive or negative pressure. As outlined above, it is preferred that the injection nozzle 320 does not rotate with the drive head mechanism 100 during the drilling step.

The step of anchoring the self-drilling rock bolt 200 in the strata 2 involves injecting hardening substances or the like into the void 4 surrounding the rock bolt 200 via the central conduit 211. The injection nozzle 320 delivers hardening substances to the fluid connection port 232, where they flow through the central conduit 211 and exit 222 at the cutting end 220 of the main shaft 210. Suitable hardening substances may include a combination of one or more of but not limited to, adhesives, hardening compositions, polymers, catalysts, resins, resin hardeners, polymeric resins, phenolic resins, cementatious or chemical grout, vinyl toluene and the like.

With reference to FIG. 9, once the rock bolt 200 is drilled into the strata 2 to the desired depth and anchored, the drill head mechanism 100 may be sufficiently displaced in an axial direction away from the driving portion 230 of the rock bolt 200 such that the coupling portion 130 is disengaged from the rock bolt 200 while the nut coupling portion 120 remains engaged with the outside surface 255 of the nut element 250. While in this second position, the drill head mechanism 100 may be rotated in the same direction again (that is, the drilling direction) in a preferred embodiment, however now the nut element 250 advances along the rock bolt 200 due to the rock bolt 200 no longer being engaged to the drill head mechanism 100 and thereby remaining stationary relative to the rotating drill head mechanism 100. The rock bolt 200 has also been at least partially glued in place at this time. The nut element 250 advances until it is pressed against the surface of the strata 2 and then tightened, placing the rock bolt main shaft 210 in tension. It should however be understood that the further rotation could be in a direction opposite to the drilling direction in certain embodiments. That is, clockwise or anti-clockwise rotation or any combination thereof can be utilised.

In FIG. 9, in addition to the nut element 250, there is also shown a dome washer 260 which may also advance up the shaft 210 of the self-drilling rock bolt 200 when the nut element 250 is advanced in the second position of the drill head mechanism 100. As can be seen from FIG. 3, the dome washer 260 may be advanced up to a bearing plate 261 which spreads the force provided by the nut element 250 being driven up the shaft 210 of the self-drilling rock bolt 200 across the surface of the strata 2.

The rock bolt 200 may include various other washers or other components located above or about the nut element 250, threaded onto the rock bolt main shaft 210 but ideally not engaged with the thread 235. For example, washers are commonly used along with the plate 261 to spread the load from the nut element 250 over a greater area of the strata. Spherical washers may also be used to allow even spread of the load when the strata is not perpendicular to the rock bolt 200. A mesh screen (not shown) may also be used that allows fluid to escape during drilling, but seals the higher viscosity resins, catalyst or other hardening substances in the void 4 surrounding the rock bolt 200. That is, it helps stop the hardening resins from falling out of the rock bolt hole or void 4. The mesh screen could move along the rock bolt shaft 210.

Typically a slow setting hardening substance will be delivered first. Sufficient volume will be delivered to fill approximately two thirds of the void 4. As the hardening substance exits 222 at the cutting end 220 it will flow down the void 4 so that it is filled from the cutting end 220 first. A fast setting hardening substance will then be supplied, filling the cutting end 220 of the void 4 and forcing the slow setting hardening substance down to the driving end 230 of the rock bolt 200. In a preferred form, an amount of slow set hardening substance is delivered after the fast set hardening substance which provides that there is no fast set hardening substance remaining in the drill head mechanism 100 or fluid delivery system 300 on completion of the injection cycle of the assembly 1.

In one embodiment, the hardening substances and a suitable catalyst are delivered together in a predetermined ratio and will generally mix sufficiently while flowing through the central conduit 211. It may be desirable, however, to rotate the rock bolt 200 shortly after supplying the hardening substances, commonly referred to as "spinning" the rock bolt 200. This would be accomplished using the drill head mechanism 100 in the first position, as during the drilling step. This will improve mixing of the hardening substances and also generate heat that may be necessary to initiate and or facilitate the hardening reaction of the hardening substances.

When the fast setting hardening substance has hardened (typically within seconds), the rock bolt 200 is now substantially anchored in the strata and may then be placed in tension. At this stage, the slow setting hardening substance has not yet hardened across a region of about the bottom two thirds of the rock bolt 200. Typically the slow setting hardening substance takes a few minutes to set. It is this region that will be placed in tension by what is referred to as tensioning the rock bolt 200. Once tensioned, the slow setting hardening substance will harden maintaining tension across the rock bolt 200.

In some prior art systems that use resins for anchoring a rock bolt 200, the resins are inserted into a pre-drilled hole in a sausage-like package. The sausage-like package can prevent resins and catalyst from mixing. For example, the sausage-like package can be inadvertently compressed at one end of the drill hole or misaligned causing the bolt to miss the catalyst and leaving unmixed resin.

The present invention removes any potential back pressurization of the hole caused by the bolt acting like a piston when pushing/spinning through the chemical cartridge therefore creating a potential piston ring at the top end of the bolt and unmixed resin. Such pressure can also contribute to the hydrofracing of the borehole strata. Hydro or hydraulic fracturing of the roof strata can occur when significant pressure is placed on the back of the hole.

One of the primary advantages of the current invention, at least in a preferred embodiment, is the possibility of automation of the system. In addition to the cost advantages, automation is desirable due to the hazardous nature of the environment in which the system is used.

To aid with automation, the nut element 250 may be temporarily fixed to the rock bolt 200 prior to use. A rubber ring 212 (best seen in FIG. 4), wax or other similar substance may be used for this purpose, such that the nut element 250 cannot be removed simply due to vibrations or handling of the components, but fails when the drill head mechanism 100 rotates the nut element 250 to tension the rock bolt 200. Temporarily fixing the nut element 250 in place only allows slight movements in position, which may accommodate the automation process.

An example of the steps involved in an automated or semi-automated method of installing a self-drilling rock bolt 200 with reference to the drill head mechanism 100, self-drilling rock bolt 200, and fluid delivery system 300 of the assembly 1 as herein before described is provided in the following but non limiting embodiment set out below.

In a first drilling step, a self-drilling rock bolt 200 as herein described is coupled to the drive head mechanism 100 wherein the bolt coupling portion 130 is engaged and the nut coupling portion 120 is engaged with the driving portion 230 of the self-drilling rock bolt 200. A drive motor 400 is then operated which rotates the drill head mechanism 230 in the drilling direction. The self-drilling rock bolt 200 is thereby rotated by the drill head mechanism 100 and may be drilled into a strata 2 as the drill head mechanism 100 and attached self-drilling rock bolt 200 is advanced towards the strata 2.

During the drilling step, the fluid delivery system 300 is delivering fluid in the form of flushing material to the central conduit 211 of the self-drilling rock bolt 200 to aid in the drilling process. The injection nozzle 320 of the fluid delivery system 300 is installed into the central hollow portion 111 of the drill head mechanism 100, however the injection nozzle 320 remains stationary whilst the drill head mechanism 100 rotates. The flushing material may be delivered from two separate sources which may be delivered separately to the outer channel 332 and the central channel 332 of the injection nozzle 320 respectively. It should be appreciated that any number of sources and channels can be utilised as discussed herein and the fluid can be in many forms such as water, gas, air, steam, cleaning fluid, flushing fluid, or the like. There may be positive or negative pressure applied to the system.

Once the self-drilling rock bolt 200 is driven to a sufficient depth in strata, the drilling step ceases and the anchoring step commences. As described above, the anchoring step involves injecting a slow set hardening substance via the fluid delivery system 300 through the self-drilling rock bolt 200 such that it begins to fill the void 4 surrounding the rock bolt 200 within the strata 2. The fluid delivery system 300 then delivers a portion of fast set hardening substance which pushes on the slow set hardening substance already delivered so that the slow set hardening substance fills the bottom portion of the void 4 towards the drilling end 220 of the rock bolt 200 and the fast set hardening substance remains in the top portion of the void 4 at the cutting tip end 221 of self-drilling rock bolt 200. In further embodiments, a further portion of slow set substance can be delivered to the self-drilling rock bolt 200 to ensure no fast set hardening substance remains near the driving end 230 of the self-drilling rock bolt 200. After the second slow set or in place of it a water, air or flush agent or the like is sent up to clean the fluid delivery system and connected piping after each rock bolt installation. The rock bolt 200 is then rotated (undertakes 'spinning') for a period of time (seconds) to ensure the hardening substances are mixed with any required catalyst. The rock bolt 200 is rotated by the drill head mechanism 100 in the first position. The self-drilling rock bolt 200 is then anchored once the fast set hardening substance has hardened. It should be appreciated that depending upon the circumstances more than one rock bolt length 200 can be installed in the drilled hole. That is, the assembly 1 provides the ability to automate coupled or long bolting.

Once the anchoring of the self-drilling rock bolt 200 has been finalized, the tensioning step commences. In this step, the drill head mechanism 100 is displaced away from the driving end 230 of the self-drilling rock bolt 200 such that the bolt coupling portion 130 is no longer in engagement with the driving portion 230 whilst the nut coupling portion 120 remains in engagement with the nut element 250. The drill head mechanism 100 is then rotated in the drilling direction (in a preferred embodiment could also be opposite the drilling direction) which rotates the nut element 250, but not the shaft 210 of the rock bolt 200 such that the nut element 250 advances up the shaft 210 of the rock bolt 200 until it is forced up against the surface of the strata and provides tension across the length of the rock bolt 200 surrounded by the slow set hardening substance. It should be appreciated that the drilling direction can be clockwise or anti-clockwise.

The self-drilling rock bolt 200 (or multiple bolts) may then be left such that the slow set hardening substance may be allowed to cure thereby providing full encapsulation of the self-drilling rock bolt(s) 200 and structural support to the strata and a second self-drilling rock bolt 200 can be engaged with the drill head mechanism 100 and installed in a different location following the same procedure as outlined above. During the drilling operation of the second self-drilling rock bolt 200 at the second location, the injection nozzle 320 may be flushed with fluid (water, steam, air, gas, cleaning fluid or the like) which also has the beneficial effect of cleaning out any remaining hardening substances from the injection nozzle 320 from the anchoring step of the previous rock bolt installation process.

Advantageously, the present invention at least in a preferred embodiment provides, a self-drilling rock bolt assembly 1 that drills it's own holes, provides full encapsulation of a rock bolt 200 by way of the injection system 300, no gloving can occur as no sausage-like package is required, the ability to provide coupled and short bolt installation, tensioning of the bolt 200 after point anchoring, a plurality of different fluid supplies and injection means opening up an ability to utilise a range of fluids simultaneously, the ability to self-drill a bolt 200 in either direction, no need for a static mixer, fluid seals contained within the bolt reducing maintenance seals, and a computer control system that automates the process, removing workers from the operation site. The present assembly 1 can be retro fitted to existing drill rigs or be stand alone. The present invention could also be utilised in combination with rotary and rotary percussive drilling. Many other modifications will be apparent to those skilled in the art without departing from the scope of the present invention.

The invention claimed is:

1. A self-drilling rock bolt assembly including a drill head mechanism and a fluid delivery system operatively associated with each other and adapted in use to secure with pre-tension, chemically, via injection, a self-drilling rock bolt into a strata; the rock bolt including a shaft having a cutting end and a driving end; the assembly including:

a. the drill head mechanism having:
- a bolt coupling portion to releasably engage with the driving end of the rock bolt, wherein rotation of the bolt coupling portion rotates the rock bolt;
- a central hollow portion providing access to a fluid connection port of the rock bolt; and,
- a nut coupling portion to releasably engage with a nut element located on the shaft of the rock bolt, wherein rotation of the nut coupling portion rotates the nut element;

b. the fluid delivery system having:
- an injection nozzle in communication with one or more sources of fluid for delivering measured quantities of one or more fluids to a predetermined location about said assembly,
- each source of fluid including a reservoir in fluid communication with a priming pump, the priming pump being in fluid communication with a replacement pump, the displacement pump being in fluid communication with the injection nozzle, so that said fluid from said reservoir is adapted to be pumped to said predetermined location;
- a cleaning flush phase for each separate internal passage within the injection nozzle, that has each cleaning fluid sourced from a different reservoir pressure source;

whereby in use said drill head mechanism drives the rock bolt into the strata by rotating in a drilling direction the rock bolt and nut element at the same rate such that the nut element remains in the same position relative to the shaft of the rock bolt.

2. The assembly according to claim 1, wherein the nut coupling portion drives an outside surface of the nut element.

3. The assembly according to claim 1, wherein the bolt coupling portion includes one or more male connectors that engage with one or more corresponding female connectors of the rock bolt, the male connectors driving an inside surface of the rock bolt.

4. The assembly according to claim 3, wherein the bolt coupling portion includes a main body with a central hollow corresponding to the central hollow of the drill head mechanism, wherein the one or more male connectors include a protrusion from a top surface of the main body extending in a direction parallel to a longitudinal axis of the central hollow and adapted to operatively couple with the female connector in the driving end of the rock bolt.

5. The assembly according to claim 4, wherein in a first position the nut coupling portion is engaged with the nut element and the bolt coupling portion is engaged with the driving end of the rock bolt, and in a second position the nut coupling portion is engaged with the nut element and the bolt coupling portion is disengaged with the driving end of the rock bolt.

6. The assembly according to claim 5, wherein the drill head mechanism advances the nut element along the rock bolt by rotating in the drilling direction while in the second position thereby tensioning the rock bolt.

7. The assembly according to claim 1 operatively associated with a self-drilling rock bolt, the rock bolt including:
- the shaft having a hollow portion defining a central conduit;
- the fluid connection port containing a fluid seal;
- the cutting end at one end of the shaft where a cutting tip is fixed; and, the driving end at the other end of the shaft adapted to operatively female couple to the drill head mechanism, wherein rotation of the drill head mechanism rotates the shaft;

the shaft including an external thread at or towards the driving end that engages with the nut element such that rotation of the nut element relative to the shaft causes the nut element to move in an axial direction along the shaft.

8. The assembly according to claim 7, wherein the central conduit provides fluid communication between a fluid connection port at the driving end and a fluid exit at the cutting end.

9. The assembly according to claim 8, wherein the coupling end includes one or more slots arranged radially about the fluid connection port, each female slot adapted to receive therein a male connector of the bolt coupling portion of the drill head mechanism.

10. The assembly according to claim 7, wherein the cutting tip is fixed to the rock bolt so that it creates a fluid exit for fluids to exit the central conduit.

11. The assembly according to claim 10, further including a mesh screen surrounding the rock bolt to permit fluid to exit a void surrounding the rock bolt by flowing through the mesh screen but resists higher viscosity hardening substances flowing therethrough to exit the void.

12. The assembly according to claim 1, wherein the fluids include one or more of:

a slow set hardening substance;

a fast set hardening substance;

a catalyst to initiate the hardening of the slow and/or fast set hardening substances;

water;

steam;

gas;

air;

cleaning fluid; and/or flushing fluid.

13. The assembly according to claim 1, including a control system to control the ratios and volumes of each fluid supplied to the rock bolt and movement of the drill head mechanism with respect to the strata.

14. The assembly according to claim 1, wherein the injection nozzle includes:

a plurality of separate internal passages through which various fluids may flow;

a needle portion of elongate shape, with one end adapted to couple with the rock bolt and including openings for fluids to exit the internal passages; and, a base portion including fluid inlets in fluid communication with the internal passages.

15. The assembly according to claim 14, wherein the base portion of the injection nozzle includes a plurality of separate inlets, wherein more than one of the inlets may be in fluid communication with the same internal fluid passage.

16. The assembly according to claim 15, wherein the injection nozzle in use extends through the central hollow of the drill head mechanism into the fluid connection port while the drill head mechanism is coupled with the rock bolt, and whereby in use the injection nozzle does not rotate as the drill head mechanism and/or rock bolt rotates.

17. A method of installation of the self-drilling rock bolt assembly of claim 1, the method including the steps of:

rotating the rock bolt and the nut element together in the drilling direction using the drill head mechanism such that the rock bolt advances into the strata;

delivering the hardening substances by the fluid delivery system;

spinning the rock bolt; and, tensioning the rock bolt by rotating the nut element in the drilling direction relative to the rock bolt, so that the rock bolt is anchored in the strata.

18. The method according to claim 17, wherein the method further includes the steps of:

a. a slow setting hardening substance is first sent through the rock bolt, then b. a fast setting hardening substance is sent through the rock bolt; then either or both;

c. a slow setting hardening substance is sent into the central conduit of the rock bolt;

and/or d. a cleaning fluid is sent into the central conduit of the rock bolt; so that the rock bolt is tensioned after the fast setting hardening substance has hardened and before the slow setting hardening substance has hardened.

19. The method according to claim 17, wherein the drill head mechanism rotates the rock bolt and nut element at the same rate in a drilling direction, causing the rock bolt to be drilled into the strata, then decouples from the rock bolt; but is still coupled to the nut via the nut coupling portion, and further rotates in the drilling direction to cause the nut element to advance along the rock bolt, thereby causing the rock bolt to be placed in tension.

20. The method according to claim 17, wherein the fluid delivery system supplies a plurality of different fluids throughout the assembly as determined by the control system.

* * * * *